United States Patent [19]

Kasima

[11] 3,970,885

[45] July 20, 1976

[54] IGNITION PLUG FOR INTERNAL COMBUSTION ENGINES

[75] Inventor: Osamu Kasima, Kariya, Japan

[73] Assignee: Nippondenso Co., Ltd., Kariya, Japan

[22] Filed: June 3, 1975

[21] Appl. No.: 583,405

Related U.S. Application Data

[63] Continuation of Ser. No. 397,905, Sept. 17, 1973, abandoned.

[30] Foreign Application Priority Data

| | | |
|---|---|---|
| Sept. 18, 1972 | Japan | 47-93988 |
| Sept. 18, 1972 | Japan | 47-93989 |
| Nov. 20, 1972 | Japan | 47-117046 |
| Nov. 29, 1972 | Japan | 47-119697 |
| Dec. 1, 1972 | Japan | 47-120845 |

[52] U.S. Cl. ..... 313/141; 123/169 EL; 313/132

[51] Int. Cl.[2] ..... H01T 13/20

[58] Field of Search ..... 313/130, 141, 118, 132; 123/169 R, 169 EL

[56] References Cited

UNITED STATES PATENTS

| | | | |
|---|---|---|---|
| 1,538,870 | 5/1925 | Champion | 313/141 |
| 1,942,242 | 1/1934 | Fitzgerald | 313/141 |
| 2,254,169 | 8/1941 | Dillon | 123/169 EL |
| 2,307,403 | 1/1943 | Haas | 313/141 |
| 2,548,170 | 4/1951 | Moth | 313/130 |
| 2,894,162 | 7/1959 | Ignatjev | 313/141 |
| 2,944,178 | 7/1960 | Schaub | 313/141 |

FOREIGN PATENTS OR APPLICATIONS

| | | | |
|---|---|---|---|
| 437,081 | 10/1935 | United Kingdom | 313/132 |

*Primary Examiner*—John Kominski
*Attorney, Agent, or Firm*—Cushman, Darby & Cushman

[57] ABSTRACT

An ignition plug for internal combustion engines in which a spark gap is established between a central electrode and a ground electrode opposed thereto and a spark discharge is generated in the spark gap so as to ignite a mixture, wherein the ground electrode takes a unique form such that it is provided with a kerf, groove, depression, projection or the like at its spark discharge area confronting the central electrode whereby the ignition ability is improved with the result that a lean mixture is useful to reduce the quantity of harmful components in the exhaust gas.

6 Claims, 43 Drawing Figures

IGNITION PLUG FOR INTERNAL COMBUSTION ENGINES

This is a continuation of application Ser. No. 397,905 filed Sept. 17, 1973, now abandoned.

This invention relates to an ignition plug for internal combustion engines and more particularly to an ignition plug wherein a ground electrode takes a unique form at its spark discharge area.

In accordance with a well-known conventional ignition plug for internal combustion engines, a central electrode is extending through the center of an insulator fastened by a metal shell, a ground electrode of rectangular section is welded to the metal shell, a spark gap is established between the central electrode and the ground electrode, and a spark is generated in the spark gap to ignite an air-fuel mixture. However, since the conventional ignition plug having such a ground electrode has poor ability for igniting the mixture by a spark discharge in the spark gap, it is necessary to use a rich mixture in comparison with a theoretical air-fuel ratio when an internal combustion engine is operated with no load or low load. A lean mixture might be used for the purpose of reducing harmful components in the exhaust gas; however, in such a case, a misfire may often be caused so that the quality of ignition plug is degraded. The U.S. Pat. No. 2,944,178 discloses an ignition plug having a ground electrode of a specified shape wherein the ground electrode is bored at the position confronting a central electrode in order to increase an output and reduce fuel consumption. The inventor of the present invention examined the ignition plug disclosed in the above-mentioned United States Patent. The experimental result shows that the ignition plug has the ability to ignite a lean mixture as lean as an air fuel ratio of at most 13.8 and a sufficient reduction of carbon monoxide cannot be achieved.

An object of the present invention is to provide an improved ignition plug capable of eliminating the conventional disadvantages described above, wherein a ground electrode is formed in a unique shape to improve the ignition ability.

Another object of this invention is to provide an improved ignition plug usable with a lean mixture and capable of reducing the harmful components in the exhaust gas.

According to this invention, an ignition plug comprises a ground electrode provided with a specifically shaped portion, for example a projection, depression, groove or kerf, at its spark discharge area confronting a central electrode, whereby flame nuclei produced by a spark generated across the central electrode and the ground electrode are conducted to the specifically shaped portion so as to be readily spread out and grown.

As a result, the ignition ability is improved and an excellent ignition is attained even when an internal combustion engine is operated with no load or low load where it is prevented from an easy ignition. Further, it is possible to ignite a lean mixture.

As described above, an ignition plug of this invention used in conjunction with a lean mixture has such advantages as to reduce considerably the quantity of carbon monoxide contained in the exhaust gas. For a similar reason, the quantity of hydrocarbon contained in the exhaust gas is also reduced. Further, there occurs no waste of fuel and the fuel consumption is considerably reduced. Furthermore, a considerable reduction in creation of carbon during the combustion process prevents deterioration of insulation in the heat receiving portion of ignition plug, i.e. creation of so-called carbon contamination, thereby assuring a sufficiently long life of an ignition plug.

The invention can be more fully understood from the following detailed description taken in conjunction with the accompanying drawings in which.

Figure 3:
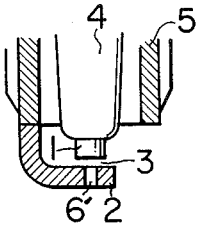
FIG.3 PRIOR ART
Figure 4:
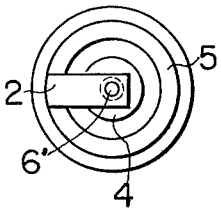
FIG.4 PRIOR ART
Figure 5:
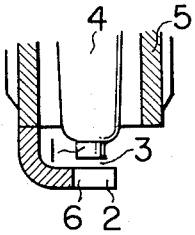
Figure 6:
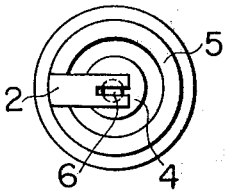
Figures 7A, 7B, 7C, 7D:
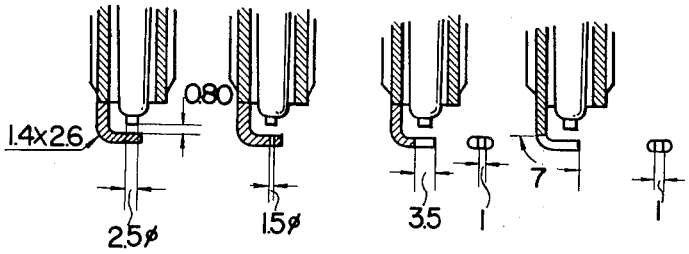
Figure 8:
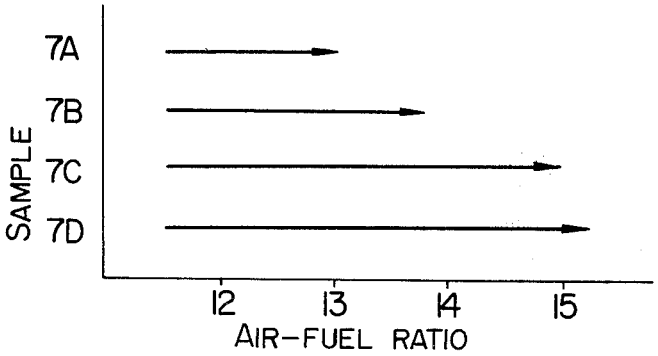
Figure 9:
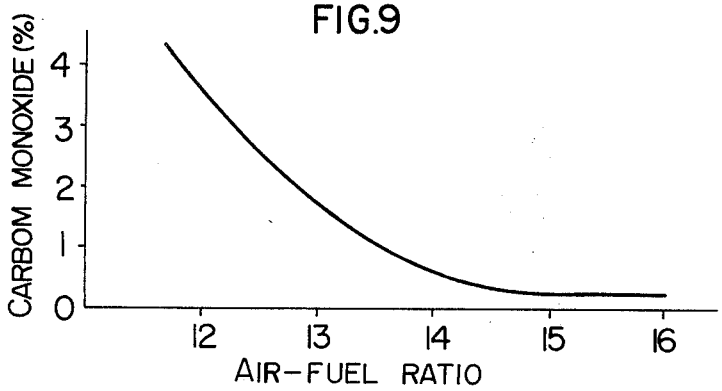
Figure 10:
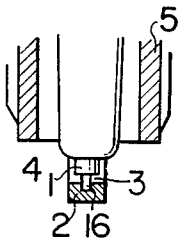
Figure 11:
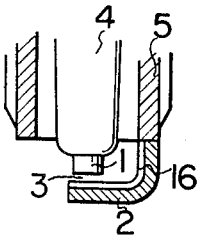
Figure 12A:
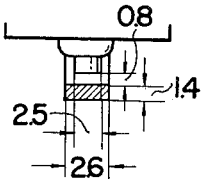
Figure 12B:
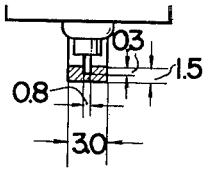
Figure 12C:
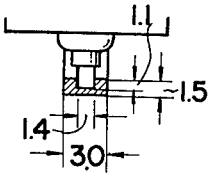
Figure 12D:
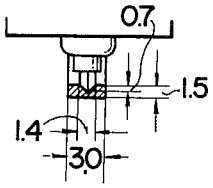
Figure 12E:
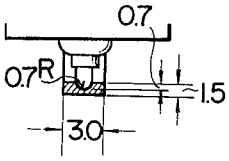
Figure 13:
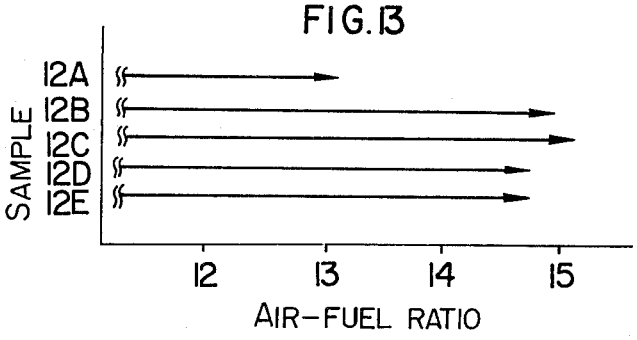
Figure 14:
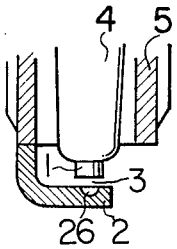
Figure 15:
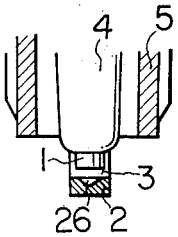
Figure 16A:
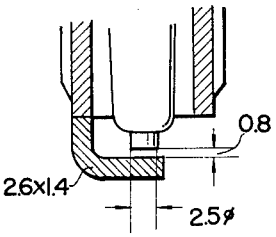
Figure 16B:
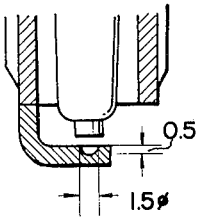
Figure 16C:
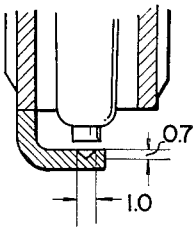
Figure 17:
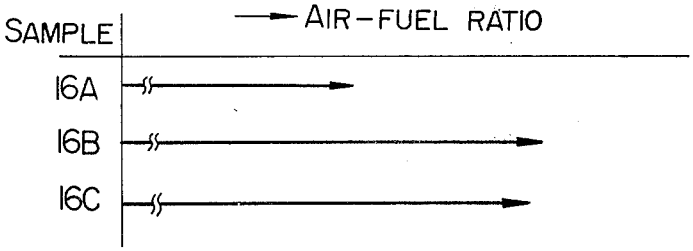
Figure 18:
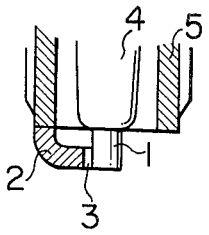
FIG. 18 PRIOR ART
Figure 19:
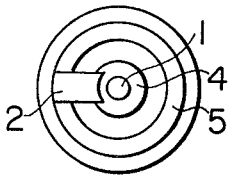
FIG. 19 PRIOR ART
Figure 20:
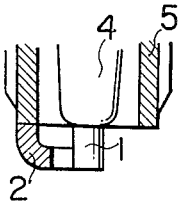
Figure 21:
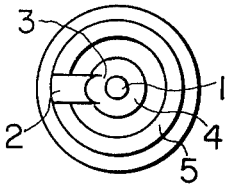
Figures 22A, 22B, 22C, 22D:
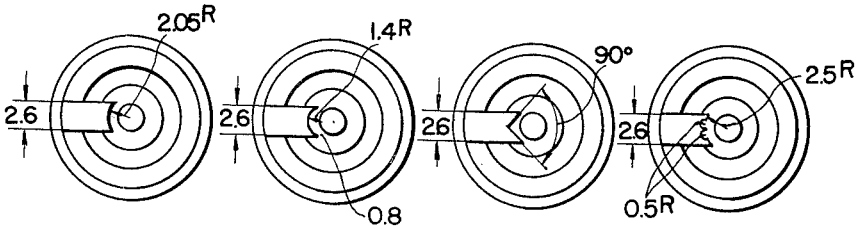
Figure 23:
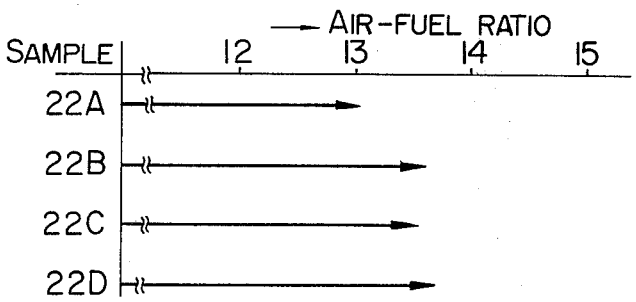
Figure 24:
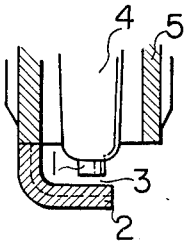
Figure 25:
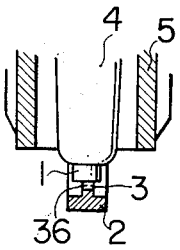
Figure 26A:
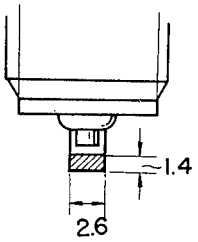
Figure 26B:
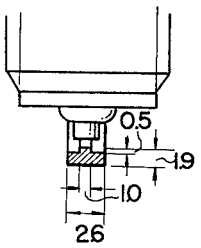
Figure 26C:
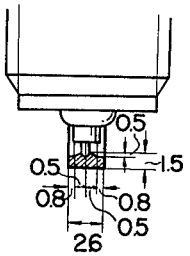
Figure 26D:
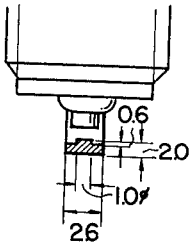
Figure 26E:
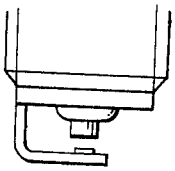

FIG. 3 is a longitudinal sectional view of a spark discharge section of an ignition plug disclosed in the U.S. Pat. No. 2,944,178;

FIG. 4 is a bottom view of the ignition plug shown in FIG. 3;

FIG. 5 is a longitudinal sectional view of a spark discharge section of an ignition plug of the first embodiment of the invention;

FIG. 6 is a bottom view of the ignition plug shown in FIG. 5;

FIGS. 7A to 7D are longitudinal sectional views of experimental samples which show dimensional relations;

FIG. 8 is a graph of the ignition limit of the experimental samples shown in FIGS. 7A to 7D;

FIG. 9 is a graph which shows a relation between the air fuel ratio and the concentration of carbon monoxide according to a four cycle gasoline engine for automobiles;

FIG. 10 is a longitudinal sectional view of a spark discharge section of an ignition plug of the second embodiment of the invention;

FIG. 11 is a longitudinal sectional view of the spark discharge section shown in FIG. 10, as viewed from side direction;

FIGS. 12A to 12E are side views of experimental samples which show dimensional relations;

FIG. 13 is a graph of the ignition limit of the experimental samples shown in FIGS. 12A to 12E;

FIG. 14 is a longitudinal sectional view of a spark discharge section of an ignition plug of the third embodiment of the invention;

FIG. 15 is a longitudinal sectional view of the spark discharge section shown in FIG. 14, as viewed from side direction;

FIGS. 16A to 16C are longitudinal sectional views of experimental samples which show dimensional relations;

FIG. 17 is a graph of the ignition limit of the experimental samples shown in FIGS. 16A to 16C;

FIG. 18 is a longitudinal sectional view of a spark discharge section of a well-known prior art ignition plug for internal combustion engines wherein the tip of a ground electrode confronts a peripheral surface of the tip of a central electrode;

FIG. 19 is a bottom view of the ignition plug shown in FIG. 18;

FIG. 20 is a longitudinal sectional view of a spark discharge section of an ignition plug of the fourth embodiment of the invention;

FIG. 21 is a bottom view of the ignition plug shown in FIG. 20;

FIGS. 22A to 22D are plan views of experimental samples which show dimensional relations;

FIG. 23 is a graph of the ignition limit of the experimental samples shown in FIGS. 22A to 22D;

FIG. 24 is a longitudinal sectional view of a spark discharge section of an ignition plug of the fifth embodiment of the invention;

FIG. 25 is a longitudinal sectional view of the spark discharge section shown in FIG. 24, as viewed from side direction;

FIGS. 26A to 26D are side views, partially sectioned, of experimental samples which show dimensional relations;

FIG. 26E is a side view of the sample in FIG. 2D; and

Figure 27:
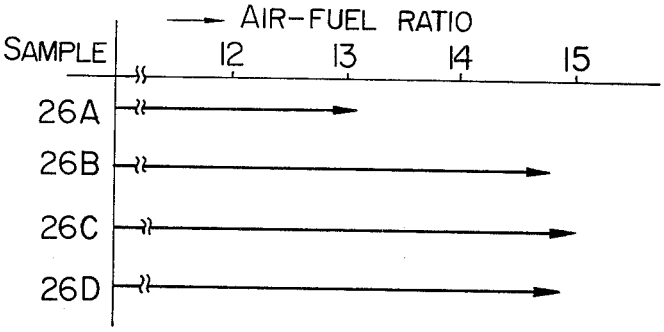

FIG. 27 is a graph of the ignition limit of the experimental samples shown in FIGS. 26A to 26D.

The first embodiment

Referring now to FIGS. 5 and 6, the first embodiment of the invention will be explained.

A basic structure of an ignition plug of the embodiment is similar to a well-known prior art one as shown in FIGS. 1 and 2 or FIGS. 3 and 4, except a ground electrode of a different shape. More particularly, a well-known prior art ignition plug comprises a central electrode 1 which is extending through the center of an insulating member 4 fastened by a metal shell 5 and a ground electrode 2 of rectangular section welded to the metal shell 5 such that a spark gap 3 is established between the central electrode 1 and the ground electrode 2, wherein a spark is generated in the spark gap 3 to ignite a mixture. Another well-known prior art ignition plug as shown in FIGS. 3 and 4 further comprises a small perforation 6′ having a diameter less than that of the central electrode, which perforation is formed through the ground electrode 2 such that it confronts the central electrode 1.

In accordance with the first embodiment of the invention, an ignition plug comprises the central electrode and the ground electrode opposed thereto which is provided with a kerf 6 at a portion of a spark discharge area for the purpose of a local temperature rise at the ground electrode. With this construction, the extinguishing function of the ground electrode is degraded, thereby enabling a lean mixture to ignite.

Turning to FIGS. 7A to 7D, FIG. 8 and FIG. 9, samples presented to an experiment and an experimental result will be explained. The experiment was executed with a four cycle gasoline engine for automobiles. FIG. 9 shows a relation between the air fuel ratio and the concentration of carbon monoxide during an idling operation. It will be seen from the graph that as the air fuel ratio becomes large, that is when a lean mixture is used, the amount of carbon monoxide contained in the exhaust gas decreases.

Figure 1:
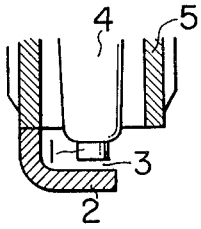
FIG.1 PRIOR ART
FIG. 1 is a longitudinal sectional view of a spark discharge section of a well-known prior art ignition plug for internal combustion engines.
Figure 2:
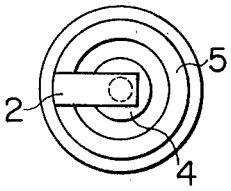
FIG.2 PRIOR ART
FIG. 2 is a bottom view of the ignition plug shown in FIG. 1.

As shown in FIGS. 7A to 7D, four experimental samples 7A to 7D each have the ground electrode of 2.6 mm width and 1.4 mm thickness and the central electrode of 2.5 mm diameter, with 0.8 mm spark gap between the ground electrode and the central electrode. It will be understood from FIG. 8 showing the ignition limit of the experimental samples that the well-known prior art ignition plug as shown in FIGS. 1 and 2 (Sample 7A) has the ignition ability below the air fuel ratio of 13 and it causes a misfire above the threshold air fuel ratio. Accordingly, with the ignition plug as sample 7A, the concentration of carbon monoxide contained in the exhaust gas cannot be decreased below 1.7%.

In case of the prior art ignition plug (Sample 7B) as shown in FIGS. 3 and 4, the dimension of which is shown in FIG. 7B wherein the diameter of a perforation is 1.5 mm, the air fuel ratio is 13.8 and it is superior to the sample 7A (shown in FIG. 7A).

Ignition plugs according to the first embodiment of the invention, as samples 7C and 7D shown in FIGS. 7C and 7D, have the ground electrodes provided with kerfs of 1.0 mm width and 3.5 mm and 7.0 mm length, respectively. As seen from FIG. 8, the ignition ability is extended up to the air fuel ratio of 15. Consequently, the concentration of carbon monoxide contained in the exhaust gas can be reduced to 0.1% to 0.2%. The reason for the superior ignition ability of the samples 7C and 7D for the air fuel ratio in comparison to the sample 7B of prior art may be as follows:

While the sample 7B has the ground electrode provided with the circular perforation 6′ the diameter of which is less than that of the central electrode, the samples 7C and 7D each have the ground electrode provided with the kerf of length exceeding the diameter of the central electrode so that in addition to the above-mentioned local temperature rise effect due to the kerf, the flame nuclei may spread out via the kerf over an extended downward neighbourhood.

The second embodiment

Referring now to FIGS. 10 and 11, the second embodiment of the invention will be described.

A basic structure of an ignition plug in accordance with the embodiment is similar to that of a well-known prior art as shown in FIGS. 1 and 2 or FIGS. 3 and 4, except that the ground electrode is of a different shape. More particularly, in this invention, the ground electrode 2 opposed to the central electrode 1 has a groove 16 formed in the surface confronting the central electrode. With this construction, the flame nuclei produced by a spark are conducted to the groove, spread out with rapidity forwardly and backwardly in the longitudinal direction, and grown easily. This permits an easy propagation of the flame. Consequently, not only the fluctuations in delay of ignition are decreased so as to ensure a quiet operation, but also the ignition ability is so improved that a lean mixture can be ignited.

Turning to FIGS. 12A to 12E and FIG. 13, samples presented to an experiment and the experimental results will be described. The experiment was executed with a four cycle gasoline engine for automobiles. In consideration of FIG. 9 showing a relation between the air fuel ratio and the concentration of carbon monoxide during an idling operation, as the air fuel ratio becomes large, that is when a lean mixture is used, the amount of carbon monoxide contained in the exhaust gas decreases.

As shown in FIGS. 12A to 12E, five experimental samples 12A to 12E each have the central electrode of 2.5 mm tip, with 0.8 mm gap between the ground electrode and the central electrode. The sample 12A is a prior art ignition plug and identifies with the sample 7A previously described.

Ignition plugs according to the second embodiment of the invention, as samples 12B to 12E shown in FIGS. 12B to 12E, each have the ground electrode of 3.0 mm width and 1.5 mm thickness. In this embodiment, the width, depth or sectional shape of a groove 16 is varied in accordance with FIGS. 12B, 12C, 12D or 12E. Namely, for the sample 12B, the groove has 0.8 mm width, 0.3 mm depth and a rectangular section; for the sample 12C, 1.4 mm width, 1.1 mm depth and rectangular section; for the sample 12D, 1.4 mm width, 0.7 mm depth and a triangular section; for the sample 12E, 1.4 mm width, 0.7 mm depth and a semi-circular section.

As seen from FIG. 13 showing the ignition limit of the experimental samples, the prior art ignition plug (sample 12A) has the ignition ability below the air fuel ratio of 13. According to this embodiment, however, the ignition plugs of samples 12B to 12E have the ignition ability above the air fuel ratio of 14.7 independent of the shape and dimension of the groove 16 provided for the ground electrode, as shown in FIGS. 12B, 12C, 12D or 12E. Consequently, the concentration of carbon monoxide contained in the exhaust gas can be reduced to the order of 0.1 % to 0.2 %.

The samples 12B to 12E are available above the air fuel ratio of 14.7 which is superior to that of 13.8 for the prior art ignition plug (the sample 7B shown with the first embodiment) having the ground electrode provided with a circular perforation. This is because the effect attained when the flame nuclei are conducted to spread out by the grooves of the samples 12B to 12E in the forward and backward longitudinal directions of the groove with successive spreading out over neighbourhood may be far more effective than the effect attained when the flame nuclei produced in the spark discharge space between the ground electrode and the central electrode pass through the perforation formed in the ground electrode so as to spread out downwardly.

While, in this embodiment, the groove 16 provided for the ground electrode 2 of the ignition plug has been formed in the longitudinal direction of the ground electrode and over the entire length thereof as shown in FIGS. 10 and 11, the groove may have other configurations.

As described above, the ignition plug of this invention has the ground electrode provided with the groove formed in the surface of ground electrode confronting the central electrode, thereby considerably improving the ignition quality and permitting the use of lean mixture.

The third embodiment

Reference is now made to FIGS. 14 and 15.

The third embodiment has a basic ignition plug structure similar to that of a prior art, except a differently shaped ground electrode. More particularly, in this invention, the ground electrode 2 opposed to the central electrode 1 has a depression 26 formed in a spark discharge area confronting the central electrode. With this construction, the flame nuclei produced by a spark are firstly repelled by the depression to spread out over the upward neighbourhood so that flame nuclei are readily grown, thereby permitting an easy propagation of the flame. Consequently, not only the fluctuations in delay of ignition are decreased so as to ensure a quiet operation, but also the ignition ability is so improved that a lean mixture can be ignited.

Turning to FIGS. 16A to 16C and FIG. 17, samples presented to an experiment and the experimental results will be described. The experiment was executed with a four cycle gasoline engine for automobiles. A relation between the air fuel ratio and the concentration of carbon monoxide during an idling operation is illustrated in FIG. 9.

As shown in FIGS. 16A to 16C, three experimental samples 16A to 16C each have the central electrode of 2.5 mm tip and the ground electrode of 2.6 mm width and 1.4 mm thickness, with 0.8 mm spark gap between the ground electrode and the central electrode. The sample 16A is a prior art ignition plug and identifies with the sample 7A previously described. In the samples 16B and 16C according to this embodiment, the diameter or depth of the depression 26 is varied in accordance with FIGS. 16B or 16C. Namely, for the sample 16B, the depression has 1.5 mm diameter, 0.5 mm depth and a semi-circular section; for the sample 16C, 1.0 mm side length, 0.7 mm depth and a square section.

As seen from FIG. 17 showing the ignition limit of the experimental samples, the prior art ignition plug (sample 16A) has the ignition ability below the air fuel ratio of 13. According to this embodiment, however, the ignition plugs of samples 16B and 16C have the ignition ability above the air fuel ratio of 14.7 independent of the shape and dimension of the depression 26 provided for the ground electrode. Consequently, the concentration of carbon monoxide contained in the exhaust gas can be reduced to the order of 0.3 %. The samples 16B to 16C are available above the air fuel ratio 14.7 which is superior to that of 13.8 for the prior art ignition plug (the sample 7B shown with the first embodiment).

While, in this embodiment, the depression 26 provided for the ground electrode of the ignition plug has been in the form of a semi-circular or square section, the depression may be in the form of a multangular section and the dimension thereof need not be so limited as shown in the figures.

The fourth embodiment

An ignition plug according to this embodiment differs from the previous embodiments in that a spark gap is established between a tip surface of the ground electrode and a peripheral surface of tip of the central electrode.

A prior art ignition plug of this type comprises, as shown in FIGS. 18 and 19, the central electrode 1 extending through the center of an insulating member 4 fastened by a metal shell 5 and the ground electrode 2 of a rectangular section welded to the metal shell 5 so that the spark gap 3 is established between the tip peripheral surface of the central electrode 1 and the tip surface of the ground electrode, whereby a spark is generating in the spark gap 3 to ignite a mixture.

Referring now to FIGS. 20 and 21, the fourth embodiment of the invention will be described. A basic structure of an ignition plug in accordance with the embodiment is similar to that of a prior art ignition plug, except for the shape of tip of the ground electrode. More particularly, the ground electrode 2 has an arcshaped tip surface which confronts the central electrode 1 and is not coaxial therewith. The tip surface has more than two pointed ends. With this construction, the flame nuclei produced by a spark are facilitated to grow and the flame propagation is readily attained. Consequently, not only the fluctuations in delay of ignition is decreased so as to ensure a quiet operation, but also the ignition ability is so improved that a lean mixture can be ignited.

Turning to FIGS. 22A to 22D and FIG. 23, samples presented to an experiment and the experimental results will be described. The experiment was executed with a four cycle gasoline engine for automobiles. A relation between the air fuel ratio and the concentration of carbon monoxide during an idling operation is illustrated in FIG. 9.

As shown in FIGS. 22A to 22D, four experimental samples 22A to 22D each have the central electrode of 2.5 mm tip diameter and the ground electrode of 2.6 mm width, with 0.8 mm spark gap, that is the minimum distance between the tip of the ground electrode and the central electrode. The sample 22A is a prior art ignition plug, as shown in FIGS. 18 and 19, which has the tip surface of the ground electrode defined by a concentric circle of 2.05 mm radius having the same center as the central electrode. The sample 22B of this embodiment has the tip surface of the ground electrode defined by an arc of 1.4 mm radius extending from a point in the vicinity of the periphery of the central electrode, as shown in FIG. 22B. The sample 22C has the tip surface of the ground electrode defined by two planes bisecting at the right angle (90°) as shown in FIG. 22C. The sample 22D has the tip surface of the ground electrode defined by four arcs as shown in FIG. 22D. In the sample 22D, as shown in FIG. 22D, the ground electrode is provided with a plurality of kerfs. It will be understood from FIG. 23 showing the ignition limit of the experimental samples that the prior art ignition plug of sample 22A has the ignition ability below the air fuel ratio of 13 and it extinguishes above the threshold air fuel ratio. However, the ignition plugs of samples 22B to 22D of this embodiment were available above the air fuel ratio of 13.5 independent of the shape and dimension of the ground electrode. Consequently, the concentration of carbon monoxide contained in the exhaust gas was reduced to the order of 1 %.

As described above, according to this embodiment the shape of the tip of ground electrode confronting the central electrode is modified such that the ignition ability is considerably improved, thereby to ensure the use of a lean mixture.

The fifth embodiment

With reference to FIGS. 24 and 25, the fifth embodiment of the invention will be described.

An ignition plug of the embodiment has a similar structure to a prior art ignition plug as shown in FIGS. 1 and 2, except the ground electrode has a different shape. More particularly, the ground electrode opposed to the central electrode is provided with a projection 36 at its spark discharge area confronting the tip surface of the central electrode. With this construction, the flame nuclei produced by a spark are spread out rapidly over the downward neighbourhood by means of the projection so that the growth of flame nuclei is facilitated thereby to ensure an easy propagation of flame. Consequently, not only the fluctuations in delay of ignition are decreased so as to ensure a quiet operation, but also the ignition ability is so improved that a lean mixture can be ignited.

Turning to FIGS. 26A to 26D and FIG. 27, samples presented to an experiment and the experimental results will be described. The experiment was executed with a four cycle gasoline engine for automobiles. A relation between the air fuel ratio and the concentration of carbon monoxide during a idling operation is given in FIG. 9.

As shown in FIGS. 26A to 26D, four experimental samples 26A to 26D each have the central electrode 1 of 2.5 mm tip diameter and the ground electrode 2 of 2.6 mm width, with 0.8 mm spark gap, that is, a distance between the upper end of the projection and the tip of the central electrode in the case that the projection 36 (FIG. 25) is provided.

The sample 26A is a prior art ignition plug. The sample 26B of this embodiment has a ridge of 1.0 mm width and 0.5 mm height provided on the surface of the ground electrode confronting the central electrode. For the sample 26D, the cylindrical projection is of 1.0 mm diameter and 0.6 mm height. FIG. 26E is a side view of the sample shown in FIG. 2D. For the sample 26C, there are provided two parallel ridges each having a triangular section. The length of the base and the height of the triangular section are 0.5 mm.

It will be understood from FIG. 27 showing the ignition limit of the experimental samples 26A to 26D that the prior art ignition plug of sample 26A has the ignition ability below the air fuel ratio of 13 and it extinguishes above the threshold air fuel ratio. According to this embodiment of the invention, however, the ignition plugs of samples 26B to 26D have an ignition ability above the air fuel ratio of 14.7 independent of the shape and dimension of the projection 36 provided for the ground electrode. Consequently, the concentration of carbon monoxide contained in the exhaust gas can be reduced to the order of 0.1 % to 0.2 %. The samples 26B to 26D are available above the air fuel ratio of 14.7 which is superior to that of 13.8 for the prior art ignition plug (the sample 7B shown with the first embodiment).

It should be noted that the shape and dimension of the projection 6 provided for the ground electrode of ignition plug are not limited to those shown in the accompanying drawing.

What we claim is:

1. An ignition plug for internal combustion engines including a central electrode and an opposed ground electrode with a spark gap therebetween so that a spark discharge is produced in said spark gap to ignite a mixture, said ground electrode having a surface confronting said central electrode a part of which is not uniform but discontinuous, the improvement in which there is provided a groove at the surface of said ground electrode confronting said central electrode, said groove extending longitudinally along the entire length of the ground electrode and but partially through the thickness thereof.

2. An ignition plug for an internal combustion engine, comprising:

a body mounting a central electrode having an axial end;

a ground electrode also mounted on said body and having an upper face portion which extends under said axial end, but is spaced therebelow to provide a spark gap where the ground electrode confronts the central electrode;

the central electrode axial end being generally flat and circular, the ground electrode face portion extending laterally past said end and being provided with means defining a groove extending incompletely therethrough, said groove extending longitudinally on the ground electrode from radially beyond said axial end toward the diametrically opposite side of the central electrode and along the entire length of the ground electrode to the body, said groove being narrower than the axial end is wide.

3. The ignition plug of claim 2 wherein the ground electrode proceeds vertically downwardly, then curves to a generally horizontal disposition to provide, where generally horizontal, said upper face portion, the groove extending along said upper face portion and into where the ground electrode curves.

4. The ignition plug of claim 3 wherein the groove is of squared, U-shaped transverse cross-section.

5. The ignition plug of claim 3 wherein the groove is of V-shaped transverse cross-section.

6. The ignition plug of claim 3 wherein the groove is of rounded, U-shaped transverse cross-section.

* * * * *